United States Patent [19]

Deloupy

[11] 4,123,889

[45] Nov. 7, 1978

[54] PROCESS OF CONSTRUCTION OF A THERMAL INSULATING WALL

[76] Inventor: Roger Deloupy, 397 bis route de Saint-Simon, 31300 Toulouse, France

[21] Appl. No.: 752,269

[22] Filed: Dec. 14, 1976

[30] Foreign Application Priority Data

Dec. 18, 1975 [FR] France ..... 75 39217

[51] Int. Cl.[2] ..... E04G 21/14

[52] U.S. Cl. ..... 52/744; 52/100; 52/204; 52/405; 52/586; 52/747

[58] Field of Search ..... 52/586, 574, 99, 98, 52/100, 405, 404, 741, 747, 610, 611, 606, 744

[56] References Cited

U.S. PATENT DOCUMENTS

| | | | |
|---|---|---|---|
| 797,950 | 8/1905 | Forster | 52/100 |
| 1,106,584 | 8/1914 | Robbins | 52/405 |
| 1,395,176 | 10/1921 | Close | 52/100 |
| 3,076,293 | 2/1963 | Baudoux | 52/204 |
| 3,204,381 | 9/1965 | Perreton | 52/606 |

FOREIGN PATENT DOCUMENTS

| | | | |
|---|---|---|---|
| 673,326 | 12/1965 | Belgium | 52/606 |
| 447,547 | 3/1968 | Switzerland | 52/586 |

*Primary Examiner*—John E. Murtagh

*Attorney, Agent, or Firm*—Shlesinger, Arkwright, Garvey & Dinsmore

[57] ABSTRACT

The invention concerns a process for construction of a thermal insulating wall, and also blocks which are suitable to carry out the process.

Each block is in the form of a prism with two grooves which extend its total length, one on one face of the block, the other on the opposite face. At the time of wall construction, insulating strips are lodged in the grooves of the superposed blocks in order to constitute a staggered thermal barrier.

The invention can be used for any construction which can benefit from good thermal insulation.

5 Claims, 5 Drawing Figures

Fig. 2
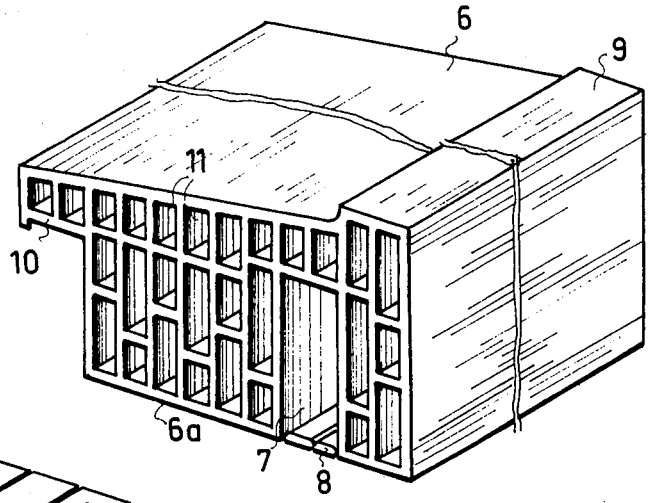
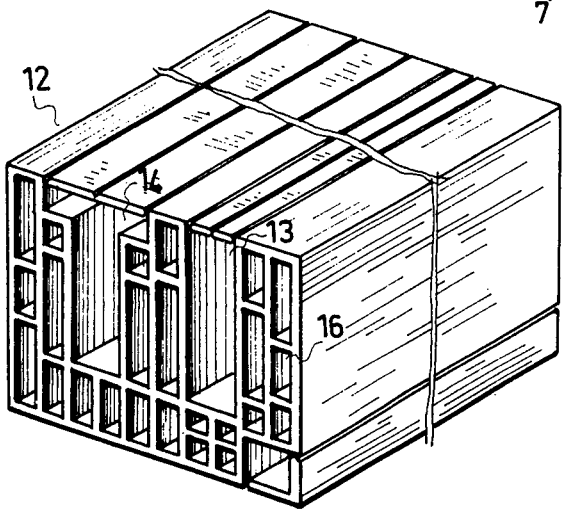
Fig 3
Fig. 4
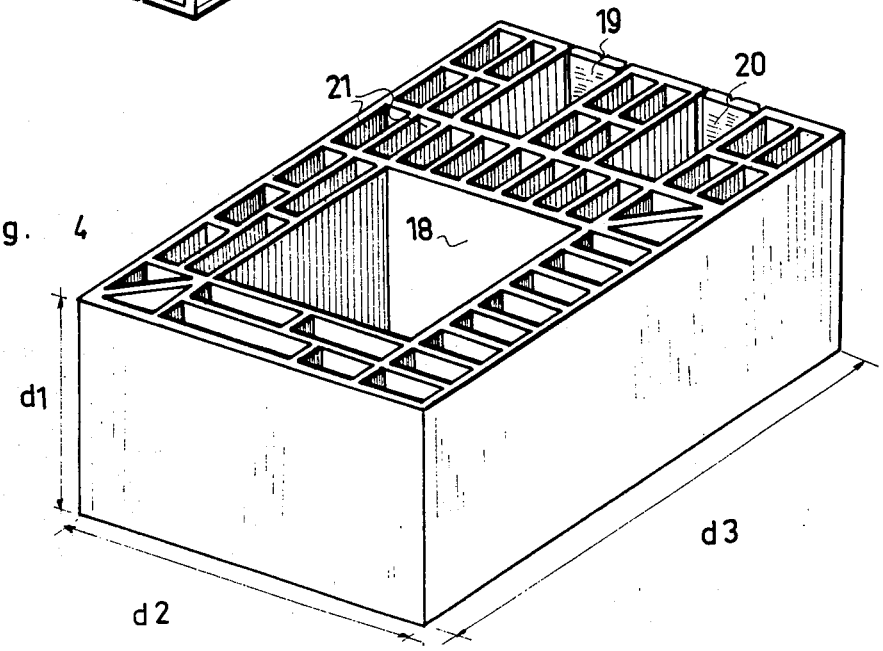

PROCESS OF CONSTRUCTION OF A THERMAL INSULATING WALL

The invention concerns a process of a thermal insulating wall.

In thermal insulating constructions, the object is to reduce thermal losses through the walls as much as possible. Traditionally, for such construction, support walls were built with ordinary bricks, then an insulating layer was applied against the inner facing of the walls, which was generally in the form of plates or semi-rigid, large surface panels. These panels were then protected by use of an inner partition wall of narrow bricks, which carries the plaster.

This construction process presents several inconveniences. On the one hand, it leads to slow and cumbersome construction since it demands successive mounting of several wall members joined side by side. Moreover, the panels or plates of insulation are costly and are to be handled delicately. Another grave inconvenience of this traditional process is that it leads to very thick finished walls; the insulating panels and the connected partition wall reduce the useable inside surfaces and increase the loads on the ceilings, thus damaging their cost effectiveness. Also the presence of these elements complicates the finishing of the architectural plans and the building on site and multiples risks of error. In order to alleviate these inconveniences, smaller bricks can be used, but the good stability of the construction is then notably effected. It is also to be noted that some types of insulating panels necessitate mounting of sealed vapor screens which are prejudicial to the bilateral respiration of the walls.

The present invention is to remedy the faults of the traditional processes.

One object of the invention is a construction process using new construction blocks and providing mounting of thermal insulating walls constituted of one single wall.

Another object of the invention is to improve the thermal insulating coefficient of the walls.

Another object is a construction process for thermal insulating walls which is simple and not cumbersome.

Another object is to permit construction of a thermal insulating wall without the possibility of continued dripping of condensation water from the top to the bottom.

Therefore, the process according to the invention consists of:

using construction blocks, called common blocks, each in the form of a prism provided with two grooves extending its entire length, the one on one face of the prism, the other on a parallel and opposite face from the first, these grooves being staggered on one and the other side of the median longitudinal plane of the two above faces and each having a depth greater than half the distance separating the two faces, so as to have facing covering portions, arranging these blocks end to end so that their grooves open on the top and the bottom faces of the row, said grooves being aligned to form a continuous groove, top or bottom, extending along the wall, putting a rigid insulating strip in place in the top groove, especially a strip of foam of a synthetic material such as polyurethane, this strip having a height on the order of double the depth of the grooves.

arranging another row of blocks above these blocks in such a manner that the projecting part of the insulating strip is lodged in the bottom grooves which are aligned with said blocks, carrying out these operations so that the strips in place in the top and bottom grooves of successive rows are arranged with some staggered relative to the others with covering portions of each strip opposite the two adjacent strips.

The blocks can be ceramic, manufactured by extrusion and firing; but this realization is not limiting and the blocks can also be realized of any other suitable material, especially of cast concrete.

Whatever the material, the blocks are manufactured according to traditional methods; it is to be noted that the commercially prepared insulating strips are mounted in the blocks on site by a simple fitting in the grooves. Thus certain processes of prefabrication of insulating bricks are avoided, which consist of casting and insulating material in the openings of the brick in the factory, which constitutes a delicate and monotonous task.

The wall which is obtained thus includes within it insulating strips arranged with some staggered relative to the others so that they form an extremely efficient thermal barrier, because the flow of heat presents a very elongated passageway to the hearts of the ceramic and the strips constitute the breaks of joints between the construction blocks; the staggered arrangement with portions of the strips overlapping two by two is essential and a determining factor to confer the high insulating property to the wall.

Considering the considerable reduction of thermal losses through these walls, it is possible to avoid the use of double window panes and especially heavy joinery, at the same time benefitting from a total insulation coefficient which is at least equal to that of traditional constructions using these elements.

Besides, the wall is comprised of one single wall mounted at one single time, which eliminates the inconveniences required by the traditional processes. Particularly, the time of mounting of the wall is essentially identical with that of a noninsulated traditional wall and is, of course, far less than that for an insulated wall with three connected walls.

A great savings of time and handling is thus realized.

With the insulation incorporated in the wall, the thickness of the finished wall is essentially equal to that of traditional noninsulated walls and no inside surface is lost. There is nothing to complicate the decoration of the architectural plans and the on site building and the load on the ceilings remains minimal.

It is to be noted that the insulation strips are not very high and are very manageable and easy to put in place.

Each strip arranged in the top grooves of a row of blocks aids in the placing and alignment of the blocks of the next row, since it serves as guide for them during mounting. Precise determination of the height of these strips relative to the depth of the grooves permits precise calibration of the thickness of the mortar joints.

Each insulating strip runs horizontally along the wall and does not establish any passage for vertical dripping of condensation water. On the contrary, in some known processes wherein vertical insulating elements are mounted (panels or vertical cells filled with insulation), these elements form drip conduits so that the insulating material at the bottom of the wall is very rapidly impregnated with water, which constitutes a very serious inconvenience to these processes (humidity of the construction, loss in insulation characteristics).

Other characteristics of the invention are shown in the following description in reference to the attached drawings, which illustrate the invention as nonlimiting examples.

FIGS. 2, 3 and 4 show perspectives respectively of a window sill, a lintel block and an angle block according to the invention.

Figure 1:
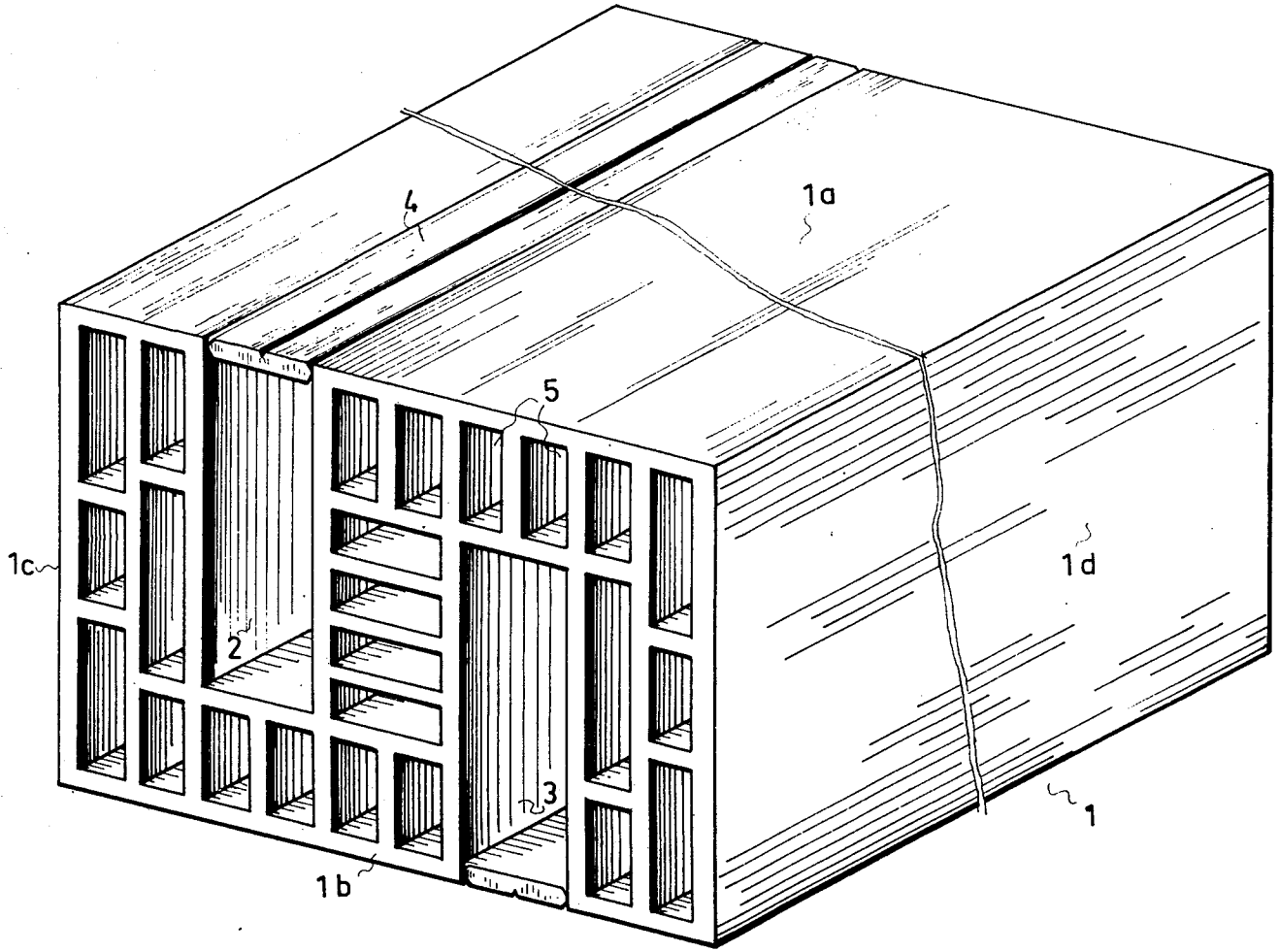
FIG. 1 shows a perspective of a common block according to the invention.

The common block shown as the FIG. 1 embodiment is a ceramic brick 1 having two recesses 2 and 3 which are each, in the example, blocked during fabrication by a partition such as 4, provided with cutting tracings: these partitions 4 are intended to be broken on site to free the recesses. They have the advantage, on the one hand, of increasing the resistance of the brick during transport and handling, and consequently, of reducing risk of accidental breaking, and on the other hand, of avoiding an accumulation of residual materials, fragments, dust, etc. . . in the recesses before the brick is laid. Of course the presence of these partitions is advantageous but not obligatory.

When these partitions are broken for the construction process, brick 1 has an S form transverse cross section, which is inscribed in a rectangle and is symmetrical relative to a point in the center of the section. The two recesses which are symmetrical relative to the middle point are identical and of rectangular form. Their depth is greater than half of the distance separating the faces 1*a* and 1*b* on which they open: thus, as shown in FIG. 1, these recesses have opposite overlap portions.

Besides, brick 1 is provided with a plurality of cells 5, extending the entire length and opening at its ends on its sides. These cells allow for bilateral respiration of the wall and permit evacuation of traces of humidity. They effect the entire cross section of the block.

This arrangement of cells 5 combined with that of the recesses in which the insulation will be lodged is conceived to cause the heat flow in a very elongated passageway to the heart of the ceramic material.

Faces 1*a* and 1*b* are fitted side by side with analogous faces of other bricks situated above and below the selected brick, but the two other lateral faces 1*c* and 1*d* are required to form the faces of the wall.

For example, the height of the brick (distance between faces 1*a* and 1*b*) can be on the order of 21 cm, its width, corresponding to the thickness of the wall, on the order of 28 cm. A common brick can have a length on the order of 40 cm.

Certain bricks intended to be arranged as a border are provided along their length with at least one cut tracing at a determined distance from one side, for example at $\frac{1}{4}$, $\frac{1}{2}$ or $\frac{3}{4}$ of their length. These bricks can then be cut on site to reduce their length.

It is to be noted that factory manufacture of these bricks of baked clay by means of traditional dies is accomplished without difficulty because of the symmetry of the brick, which makes the thrusts of the operation symmetrical at the discharge from the dies and avoids any risk of deformation or twisting of the products obtained.

Besides, FIG. 2 shows a window sill block required to constitute the base of a window; this block is constituted of a brick 6 having a recess 7 identical to that of the common bricks and opening on the bottom face 6*a* in proper position to fit the mounting of a common brick opposite; in the example, recess 7 is protected, during manufacture, by a partition 8 with cutting tracings to permit its breakage on site.

This window sill brick has a transverse cross section prepared with ledge 9 and water jet 10 and has, as the common brick, the cells 11 extending along its entire length.

FIG. 3 show a lintel block to constitute the lintel of an opening; this block is constituted of a brick 12 which has, on the one hand, a recess 13 identical to those of the common bricks and on one face in suitable position to aid in the mounting opposite of a recess of another brick, and on the other hand, a recess 14 on the same face and particularly presenting a T-shaped section to slide a concrete girder in thereon site, if reinforcements are used.

Recess 14 as well as recess 13 before can be protected by closure partitions with cutting primings so that they can be broken on site.

At the level of a bottom angle, this lintel brick has a cutout 15 which forms a lodging for the top traverse of a window or door frame; in the example, this cutout is also protected, during manufacture by a partition with cutting primings to permit it to be broken on site. As the other bricks, lintel brick 12 has cells 16 extending along its entire length.

FIG. 4 shows an angle block to be placed at the angle of a construction; this block is constituted of a brick comprising a passage 18 for the casting of an angle post, and two recesses 19 and 20 of identical size to those of the common bricks, and both opening on one face of the block, in suitable position so that one of them serves for the mounting by being situated opposite a recess of a common brick.

As before, these grooves can be protected by closure partitions with cutting primings to permit them to be broken on site.

This angle brick has cells 21, with their arrangement as shown in FIG. 4. Contrary to the others, this angle brick is to be arranged so that its cells are vertical; consequently, the distance *d*1 separating the edges of the brick is equal to the height of the other bricks (for example 21 cm), distance *d*2 is equal to the width of the other bricks which make up the thickness of the wall (for example 28 cm), and distance *d*3 is equal to the length of the other bricks (for example approximately 40 cm).

Figure 5:
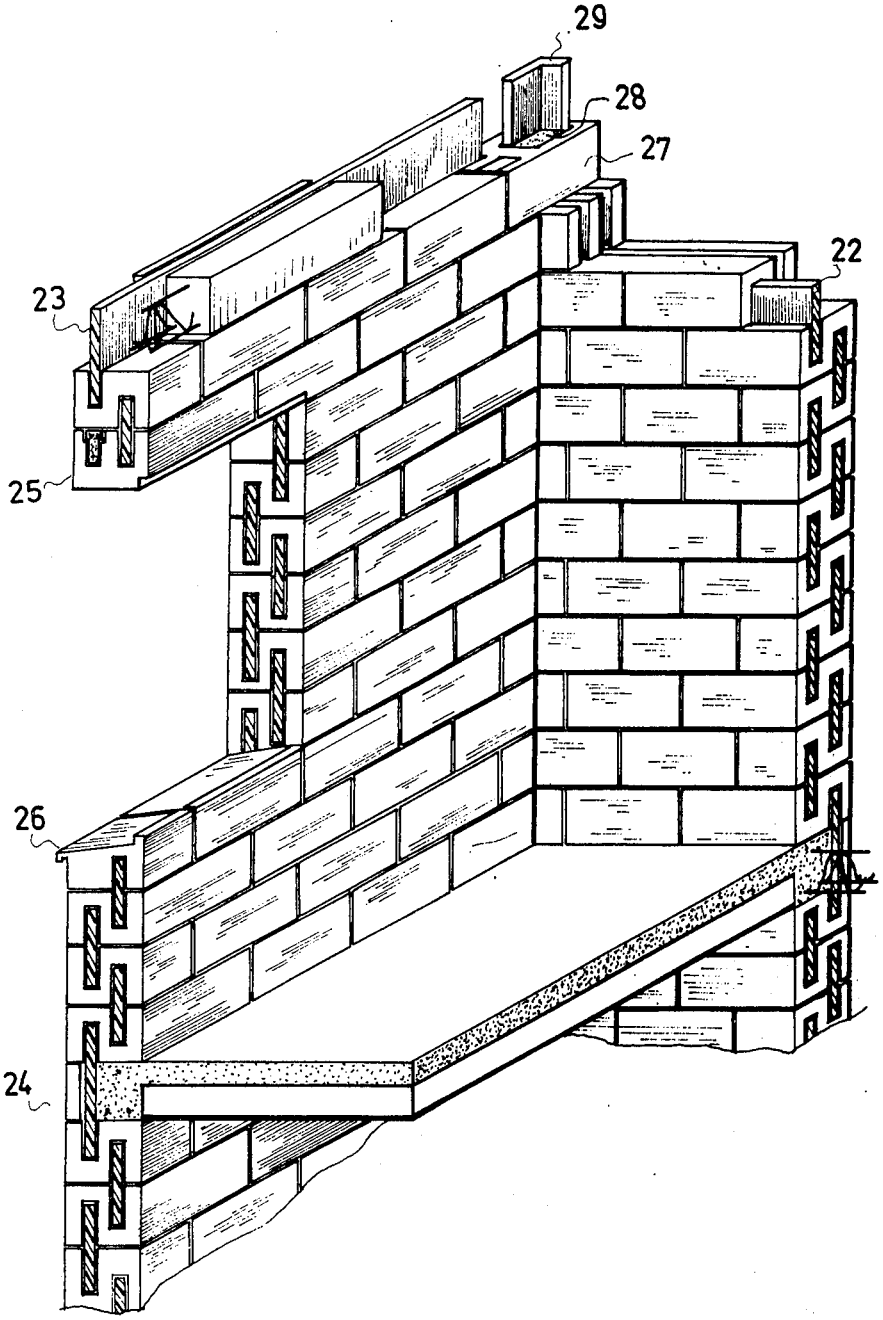
FIG. 5 is a partial diagram of a wall realized by the process according to the invention.

FIG. 5 shows the process according to the invention by showing a wall which is realized by application of the invention. The bricks are successively superposed, row after row, so that the recesses are opposite each other and delineate the parallelepipedic cutouts wherein are found the insulating strips 22. The height of these strips is equal to double the depth of a recess plus the thickness of the mortar joint. As in FIG. 5, these strips are thus staggered, with overlapping portions, and they constitute an efficient barrier to thermal transmission; the cells increase the length of the passage of the thermal flow to the heart of the ceramic material, while permitting evacuation of traces of humidity.

To the right of the top clamping 23 and of the bottom clamping 24, an insulating strip very effectively protects a break.

At 25 and 26 are the lintel bricks and the window sill bricks, mounted at the top and bottom of a bay.

Angle bricks 27 are found at the angle of the wall so that their recesses are found opposite and at the end of the cutout formed by the recesses of the common bricks of the corresponding row; the insulating strip lodged in this cutout penetrates into this recess of the angle block. Besides, before casting concrete to form a post 28, the insulating strips 29 are arranged vertically against two sides of the vertical passage of the angle blocks; post 28 can of course be provided with reinforcements in the traditional manner.

This invention can be used in any construction which would benefit from good thermal insulation: individual residence, apartment building, public building, administrative or industrial, farm buildings, refrigerated warehouse, cold chamber, etc. . . It can be used both in cold countries and in hot countries.

What I claim is:

1. A process for constructing a thermally insulated wall comprising:

providing a plurality of construction blocks, each having the form of a prism with two recesses extending along the entire length on parallel, opposite faces of the prism, said recesses being staggered on either side of a median longitudinal plane of said faces, said recesses each having a depth greater than half the distance between said faces, each of said recesses being closed by covers integrally formed with said blocks and joined to said blocks along score lines, removing said covers by breaking along said score lines, arranging a first quantity of said blocks end to end in a first row so that said recesses open to the top and bottom, said recesses in adjacent blocks forming a continuous cutout along each row, placing a rigid insulating strip having a height of approximately twice the depth of one of said recesses into said continuous cutout, arranging a second quantity of said blocks end to end in a second row above said first row and aligned so that said insulating strip is located in the bottom cutout of said second row, providing an opening in said wall, placing lintel blocks end to end at the top of said opening, said lintel block each having the form of a prism and being provided with a first recess in the top face thereof and positioned opposite the recess in the bottom face of said construction blocks and a second longitudinal recess having a T-shaped cross section in said top face, said first and second recesses of each block being aligned with the first and second recesses of adjacent lintel blocks, and casting a concrete post member in said aligned second recesses.

2. A process as in claim 1 and wherein:

each of said lintel blocks is provided with a longitudinal notch, and positioning the top member of a door or window frame in said notch.

3. A process for constructing a thermally insulated wall comprising:

providing a plurality of construction blocks, each having the form of a prism with two recesses extending along the entire length on parallel, opposite faces of the prism, said recesses being staggered on either side of a median longitudinal plane of said faces, said recesses each having a depth greater than half the distance between said faces, each of said recesses being closed by covers integrally formed with said blocks and joined to said blocks along score lines, removing said covers by breaking along said score lines, arranging a first quantity of said blocks end to end in a first row so that said recesses open to the top and bottom, said recesses in adjacent blocks forming a continuous cutout along each row, placing a rigid insulating strip having a height of approximately twice the depth of one of said recesses into said continuous cutout, arranging a second quantity of said blocks end to end in a second row above said first row and aligned so that said insulating strip is located in the bottom cutout of said second row, forming a corner in said wall by providing angle blocks in said rows at said corner, said angle blocks including a vertical passageway at one end thereof and two recesses having widths equal to the width of the recesses in said construction blocks and opening at the other end of said angle blocks for receiving in one of said recesses an insulating strip extending from a recess in the adjacent construction block.

4. A process as in claim 3 and including:

positioning subjacent angle blocks so that said vertical passageways are in vertical alignment, positioning insulating strips said vertical passageways and casting concrete in said vertical passageways so as to form a post therein.

5. A process for constructing a thermally insulated wall comprising:

providing a plurality of construction blocks, each having the form of a prism with two recesses extending along the entire length on parallel, opposite faces of the prism, said recesses being staggered on either side of a median longitudinal plane of said faces, said recesses each having a depth greater than half the distance between said faces, each of said recesses being closed by covers integrally formed with said blocks and joined to said blocks along score lines, removing said covers by breaking along said score lines, arranging a first quantity of said blocks end to end in a first row so that said recesses open to the top and bottom, said recesses in adjacent blocks forming a continuous cutout along each row, placing a rigid insulating strip having a height of approximately twice the depth of one of said recesses into said continuous cutout, arranging a second quantity of said blocks end to end in a second row above said first row and aligned so that said insulating strip is located in the bottom cutout of said second row, providing a window opening in said wall, positioning a sill block at the bottom of said window opening, said sill block having a recess in the bottom thereof in a position so as to be in alignment with the recess in the top face of a subjacent construction block, and providing an insulating strip lying in said sill block and the subjacent construction block.

* * * * *